US005100513A

United States Patent [19]

Crawford

[11] Patent Number: 5,100,513

[45] Date of Patent: Mar. 31, 1992

[54] DEFLOCCING AND DISTRIBUTION ROLLS FOR PAPERMACHINE HEADBOX

[76] Inventor: Robert R. Crawford, 616 Dorset Dr., Middletown, Ohio 45044

[21] Appl. No.: 629,719

[22] Filed: Dec. 17, 1990

[51] Int. Cl.[5] ..... D21F 1/02

[52] U.S. Cl. ..... 162/342; 162/216; 162/344

[58] Field of Search ..... 162/342, 336, 216, 344

[56] References Cited

U.S. PATENT DOCUMENTS

| | | | |
|---|---|---|---|
| 1,841,693 | 1/1932 | Aldrich et al. | 162/342 |
| 2,440,727 | 5/1948 | Rosmait | 162/342 |
| 2,688,276 | 9/1954 | Showers | 162/343 |
| 2,756,650 | 7/1956 | Lee | 162/214 |
| 3,224,929 | 12/1965 | Fair | 162/342 |
| 3,255,074 | 6/1966 | Salomon et al. | 162/342 |
| 3,328,237 | 6/1967 | Notbohm | 162/342 |
| 3,597,818 | 8/1971 | Beck | 162/342 |
| 3,674,633 | 7/1972 | Evalahti | 162/342 |
| 3,694,312 | 9/1972 | Skoldkvist | 162/342 |
| 3,758,378 | 9/1973 | Berger et al. | 162/216 |

FOREIGN PATENT DOCUMENTS

| | | | |
|---|---|---|---|
| 0616209 | 7/1933 | Fed. Rep. of Germany | 162/342 |
| 0143853 | 10/1950 | Sweden | 162/342 |

*Primary Examiner*—Karen M. Hastings

[57] ABSTRACT

Apparatus for even distribution of, and for maintaining fibrous slurries in a deflocculated state in close proximity to the slice of a papermachine headbox, respectively. The apparatus, in the first instance, comprises one or more axial (center) flow distributor rolls feeding slurry to headboxes or other vessels. Secondly, a single or multiplicity of rectifier rolls or devices rotating inside a master, or outer, roll are housed in semi-circular, or other shaped, compartments located in the headbox front plates.

4 Claims, 7 Drawing Sheets

DEFLOCCING AND DISTRIBUTION ROLLS FOR PAPERMACHINE HEADBOX

BACKGROUND OF THE INVENTION (1) Field of the Invention

The production of fibrous webs or sheets of paper or paperboard in which the present invention is concerned with submerged rolls and other submerged rotating and fixed elements, all arranged and operated in a different and unique fashion.

(2) Description of the Prior Art

In the manufacture of paper, the presence of static electrical charges on the cellulosic fibers and on particles of clay and other filler materials, including residual resins, are regarded as the primary cause for such fibers to flocculate, i.e., cling together or clot, forming "bundles" which are detrimental to the paper's formation, water removal (including drying), appearance and function of the final marketable paper product.

Minimizing flocculation has been the objective of many patented devices, one of these being Beck U.S. Pat. No. 3,597,818 patented Aug. 1971, where holes in rectifier rolls (a.k.a. "holey" rolls, mixing rolls, etc.) are drilled/honed, e.g., to a flared streamlined form through the wall of the roll shell. Beck's idea was to align the outward-flowing fibers into equally-spaced, parallel paths as they exit the roll downstream to the slice, a spout-like member depositing the fibrous slurry onto the forming wire of the papermaking machine.

Another example is Skoldkvist U.S. Pat. No. 3,694,312 patented Sept. 1972, an attempt to cure or alleviate flocculation by two separate and distinctive devices: means to intermittently introduce the fibrous suspension into the headbox, thereby creating a pulsating flow into the box above the area where the slurry enters the box, some distance, fortunately, from the slice; pulsations not dampened out before entering the slice are reflected in the newly-forming paperweb as ripples or waves that, at best, lower sheet quality, but often cause rejection of such flawed paper.

Skoldkvist's second anti-floccing device, in the same patent, comprises stiring rods radiating outward from a central, driven shaft, three rod-sets, each set positioned to keep slurry agitated as it progresses from the pulsating inlet into the slice.

Yet another is Evalahti U.S. Pat. No. 3,674,633 patented July 1972, a mechano-electrical drive device for maintaining a constant, or fixed, position of the rectifier roll relative to the movable front slice plate. The idea is to retain the roll's intimate clearance with the upper and lower slice plate. The claims cover several power sources to move the roll in conjunction with the movement of the slice plate.

Then there is the "family" of patents termed the "bunched tube" concept to anti-flocculation, the forerunner of these being Showers U.S. Pat. No. 2,688,276 patented Sept. 1954. Later members of the family are: Burgess et al U.S. Pat. No. 3,328,236 June 1967, Notbohm U.S. Pat. No. 2,328,237 June 1967, and Notbohm 3,528,882 Sept. 1970, that stand out among others. The concept employs a multiplicity of small-bore tubes, or other small cross sections, running closed-spaced in parallel, the tube bundles converging into the mouth of the slice, the bundle usually preceded by a standard rectifier roll. Supplemental flow straighteners are also covered by the same patents.

Summary

None of the citations, as well as the many others, recognize and provide for the electro dynamics of fibers in suspenson, particularly the speed at which fibers bundle, then rebundle after being temporarily separated by the prior art exemplified above.

None of the literature on fluid dynamics adequately, if at all, deals with the rapidity that fibers move through the bundling-debundling-rebundling cycles. To make a comparison of the phenomenon, it is known that the speed of electricity carried by a wire, or on a semiconductor at zero resistance, approaches that of light, which for purposes of this Summary, is nearly instantaneous. In papermaking, however, such bundling cycles are relatively slowed by myriad distances between fibers in solutions, such distances being directly related to the consistency of the slurry. In paper manufacture, headbox consistency ranges between 0.1% to 1.0%, depending upon the kind of paper end product (tissue, toweling, printings and writings, boxboard, etc.).

It is apparent that the closer any debundling (deflocculation) device—rolls in the present invention—are to the point where the slurry "freezes" on the forming wire, the better the chance of decreasing fiber bundles and their deleterious effects on paper manufacture and product quality. This proximity-to-slice concept, together with axial flow distribution, are the core concepts of this invention.

DETAILED DESCRIPTION OF THE DRAWINGS

Figure 1:
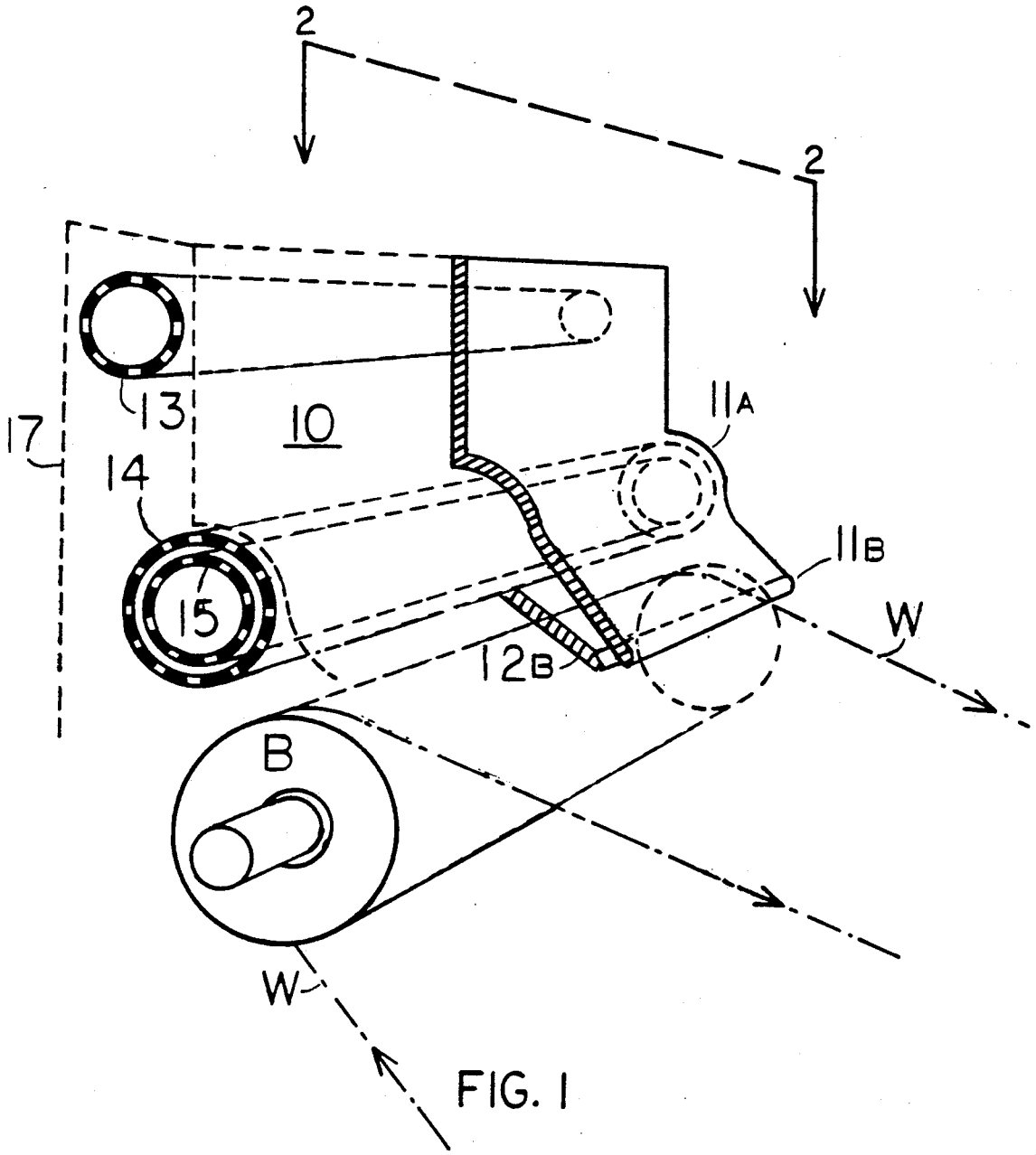
FIG. 1 shows a headbox according to the invention.

FIG. 1: Fragmented isometric-perspective of headbox 10 viewed from tending aisle, showing compartment bulge in upper front plate 11*a* enclosing double rectifier roll defloccing cluster 14 and 15, and a portion of flexible upper slice lip 11*b* secured to 11*a*; lower front plate 12*a* (not visible) contiguous with fixed slice floor 12*b*, the two portions forming a projection slice for depositing fibrous slurry onto forming wire W, a continuous (endless) belt traveling partially around breast roll B towards subsequent drainage equipment of a horizontal fourdrinier, or fourdrinier-type papermaking machine; an Axial-Flow distributor roll 13 protrudes through sidewalls visible only in FIG. 4 as parts 37; rear stabilizer wall 17.

Figure 2:
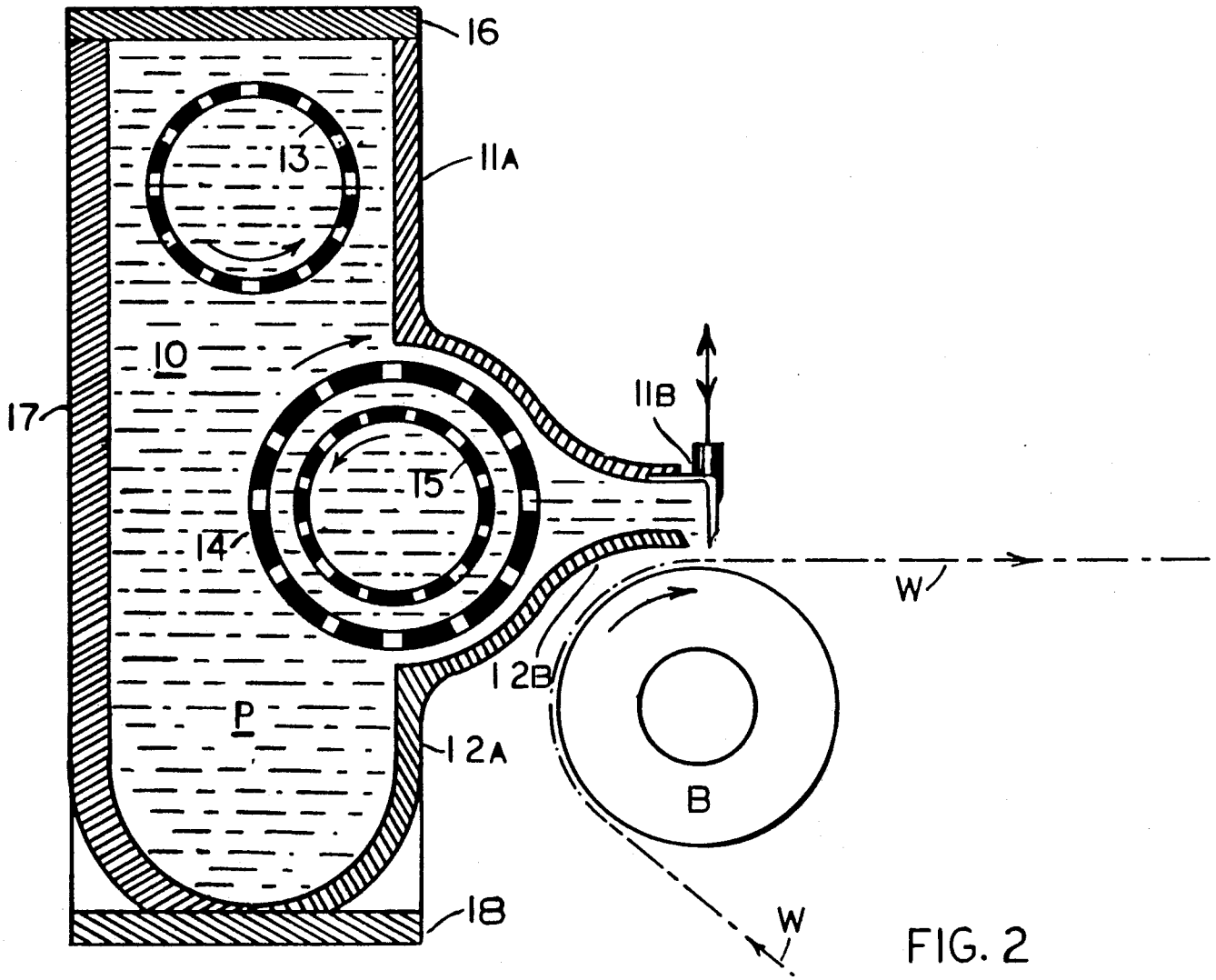
FIG. 2 shows a sectional end elevation of the headbox along section line 2—2 of FIG. 1.

FIG. 2: A sectional end elevation of headbox 10 as viewed from section line 2—2 of FIG. 1, showing rear stabilizer wall 17, and additionally, top seal cover 16, floor baseplate 18 in addition to the other parts identified in FIG. 1.

Figure 3:
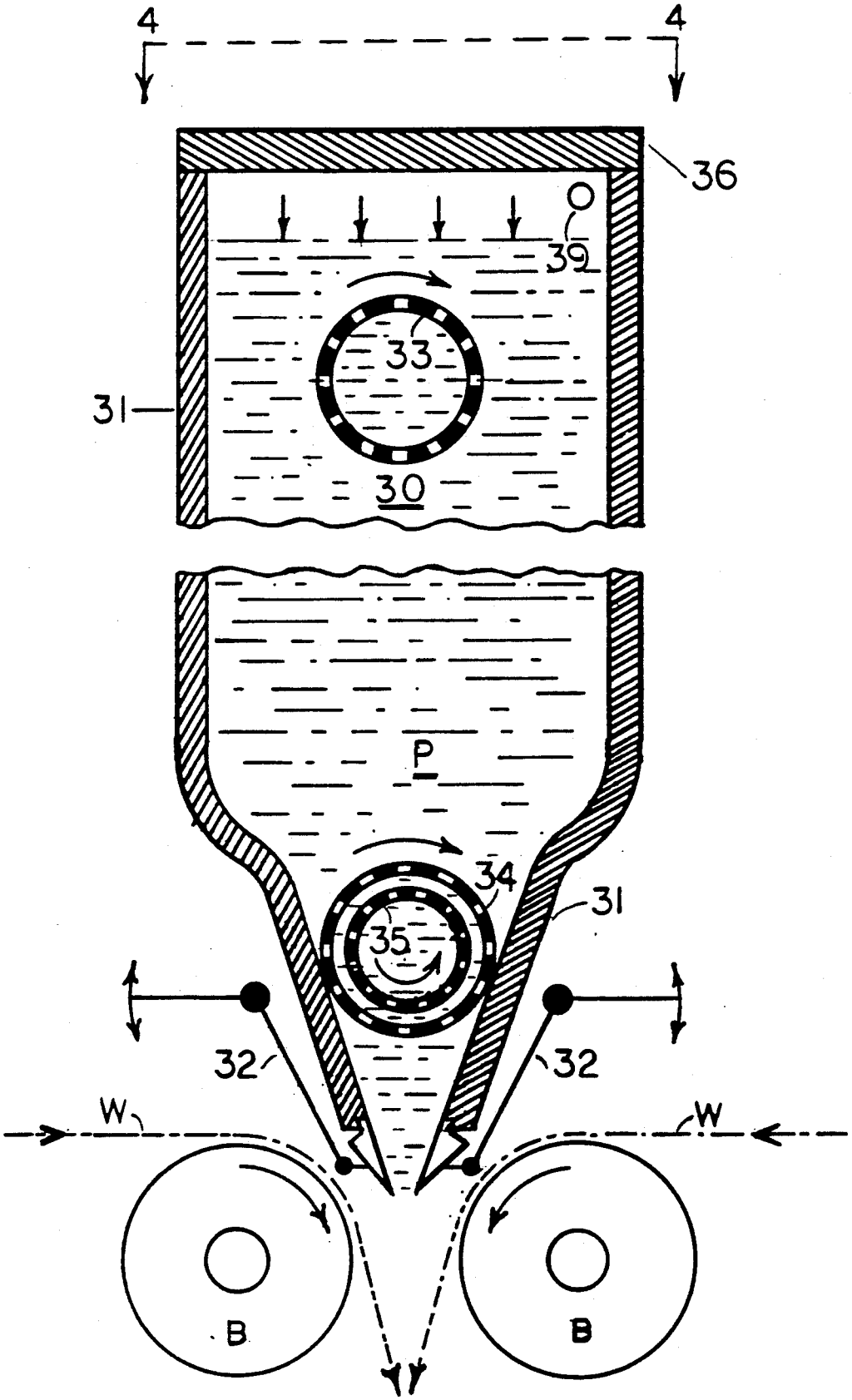
FIG. 3 shows another embodiment of a headbox according to the invention in a vertical twin wire papermachine.

FIG. 3: A sectional end elevation of an air-loaded headbox 30 viewed from a tending walkway (not shown) parallel to the horizontal runs of two forming wires of a vertical twin-wire paperformer, centrally positioned for feeding fibrous slurry into a converging nip formed by the angular downward travel of two continuous (endless) forming wires trained partially around breast rolls B, then descending towards subsequent drainage equipment; headbox 30 comprises transverse vertical sidewalls 31 contiguous with a symmetrically tapered lower portion forming the fixed slice walls of a funnel slice chamber containing, as one of several optional types, a double rectifier roll defloccing cluster 34 and 35, each tapered wall mounting a flexible knife lip with pivoted linkage 32 actuated by warping rods equally spaced across-machine width for adjustment of the slice opening; headbox 30 also includes top seal cover 36, and compressed-air inlet 39; an Axial-Flow distributor roll 33 protrudes through sidewalls and into inlet boxes, these latter two shown only in FIG. 4 as parts 37 and 38, respectively.

Figure 4:
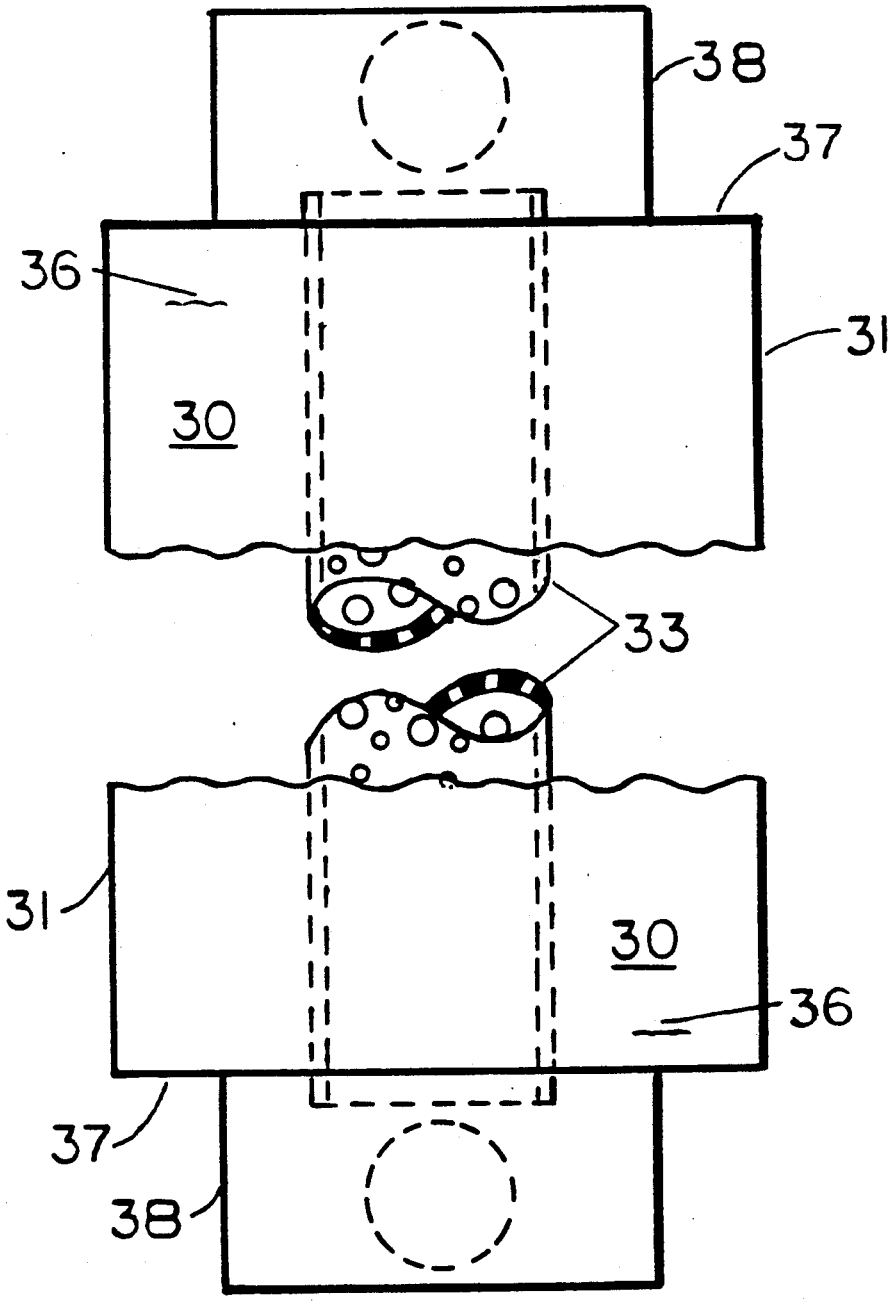
FIG. 4 shows a top plan view on view line 4—4 of FIG. 3.

FIG. 4: A top plan of headbox 30 as viewed from a central point on view line 4—4 above FIG. 3, showing the Axial-Flow distributor roll 33 partially in phantom below seal plate 36 and spanning the across-machine width of headbox 30, each end of the roll protruding into an inlet box 38, one of which is secured to each end plate 37; the shell of roll 33 is drilled to a pattern of graduated diameters calculated to produce a uniform volume of slurry exiting evenly along the roll's length into the surrounding pressurized pond.

Figure 5:
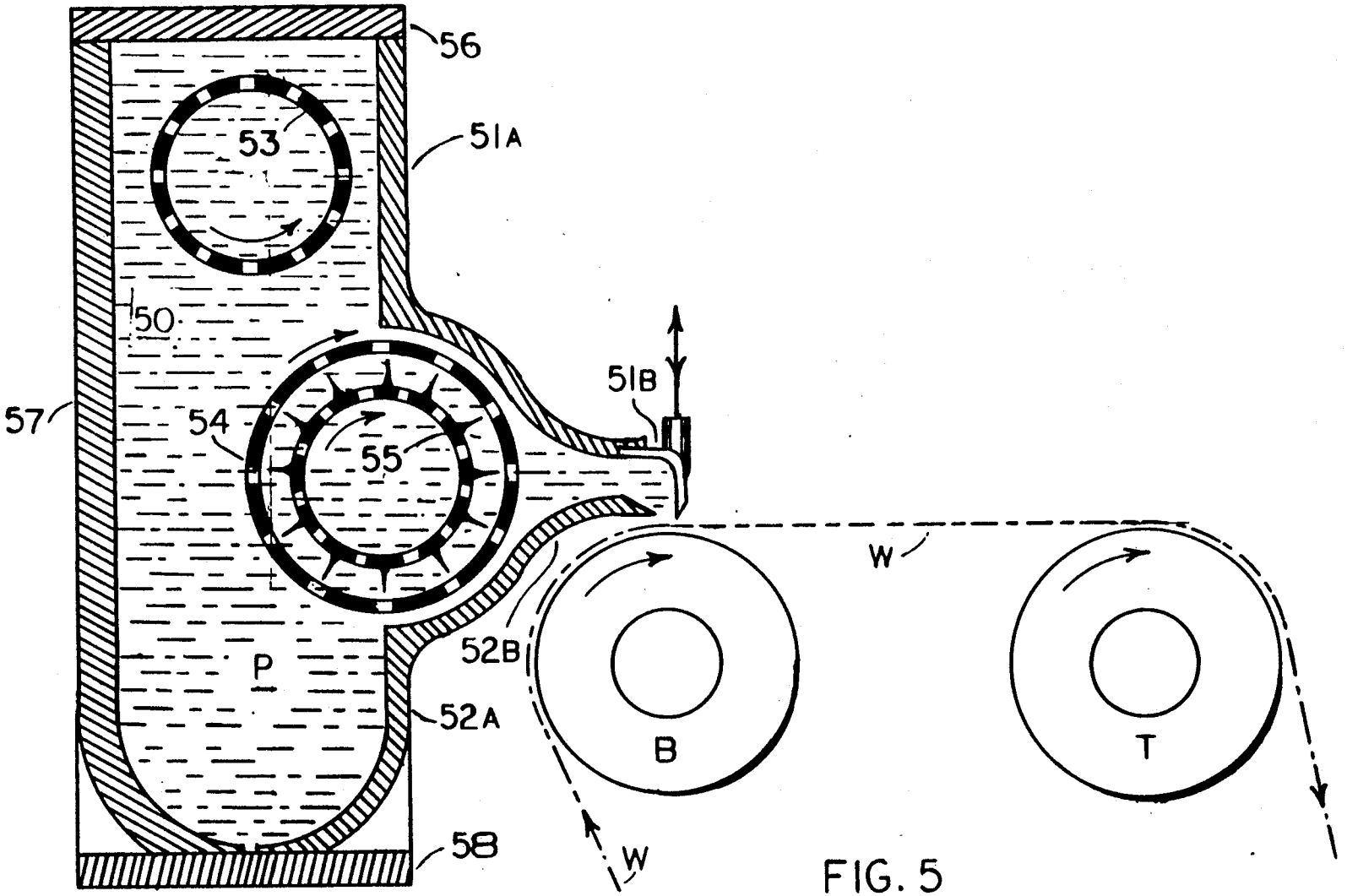
FIGS. 5 and 6 show alternative embodiments of double rectifier roll defloccing clusters.

FIG. 5: Similar to FIGS. 1 and 2, except showing, as an example of several optional types, a splined inner perforated roll 55 of the defloccing cluster, inside outer roll 54; FIG. 5 also includes upper front plate 51*a*, flexible upper slice lip 51*b*, lower front plate 52*a* contiguous with fixed slice floor 52*b*, Axial-Flow distributor roll 53, top seal cover 56, rear stabilizer wall 57, floor baseplate 58, forming wire W trained around portions of breast roll B and turning roll T, respectively, of a multiply vertical board former shown in total by FIG. 7.

Figure 6:
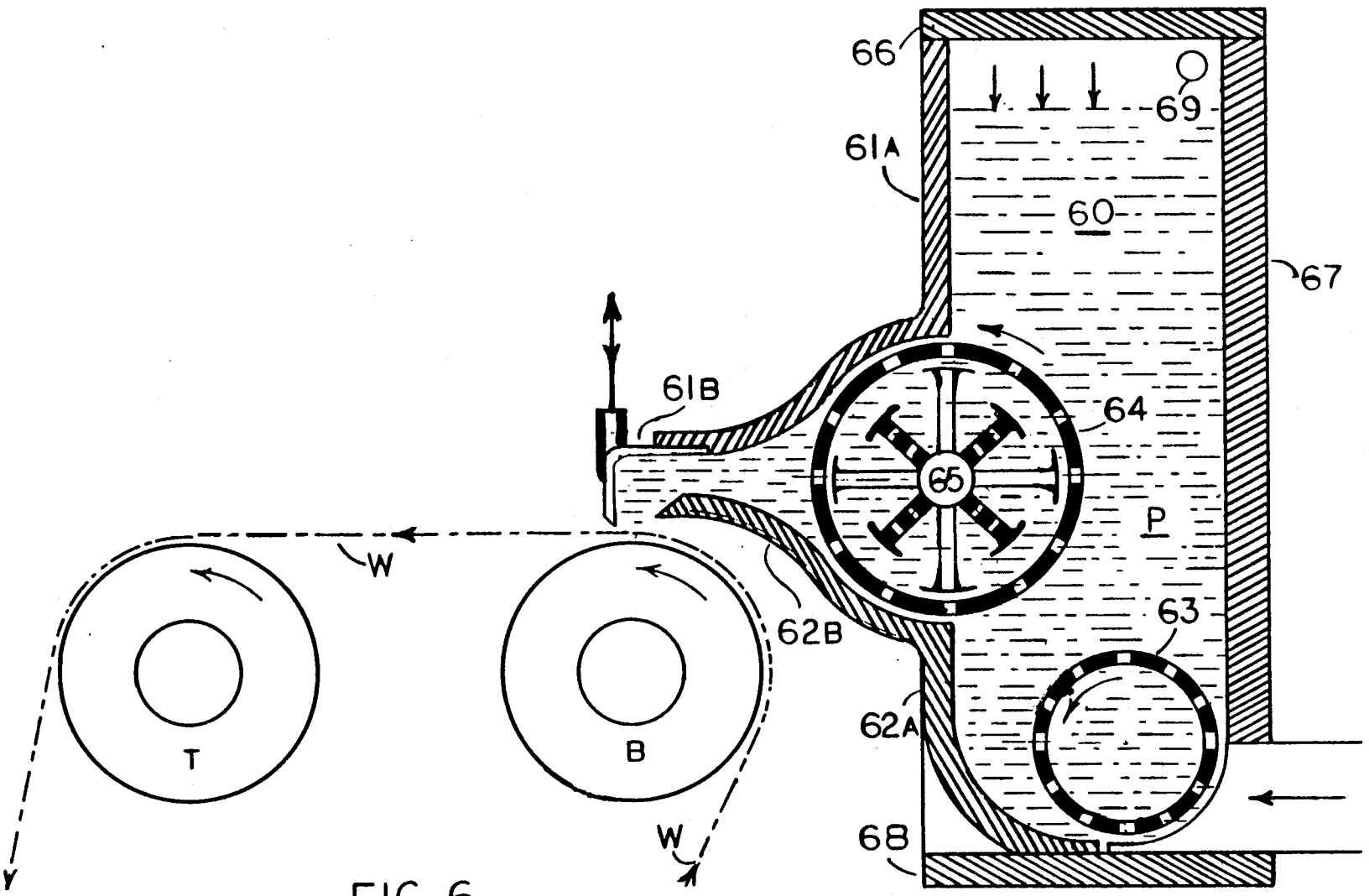

FIG. 6: Also similar to FIGS. 1 and 2, except showing air-loaded, bottom inlet headbox 60 and, as an example of other optional types, an inner defloccing member 65 consisting of a concentric, driven shaft mounting a series of foils transverse the machine width, secured to spokes of several lengths radiating outward from the shaft to co-operate at several different clearances with the inner surface of outer roll 64; FIG. 6 also includes upper front plate 61*a*, flexible upper slice lip 61*b*, lower front plate 62*a* contiguous with fixed slice floor 62*b*, Axial-Flow distributor roll 63, top seal cover 66, compressed air inlet 69, and forming wire W of opposite hand to that in FIG. 5, and as shown in total by FIG. 7.

Figure 7:
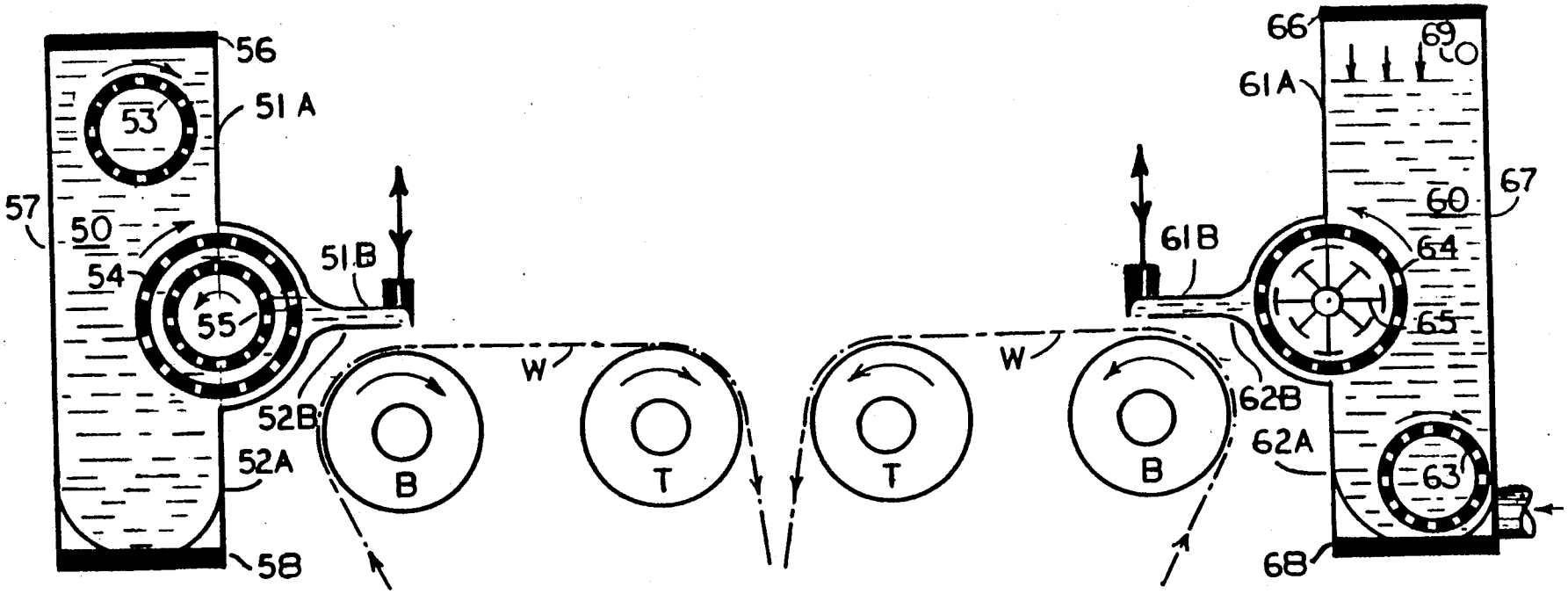
FIG. 7 shows a diagramatic combination of the headboxes of FIGS. 5 and 6.

FIG. 7: A diagramatic combination of headboxes 50 from FIG. 5 and 60 from FIG. 6, showing the adaptability of the close-proximity-to-slice headbox and Axial-Flow distributor roll concepts to all paper- and paperboard machines and formers, whether vertical, horizontal or slanted fourdrinier types, or cylinder machines; all reference characters are the same as those for FIGS. 5 and 6.

DESCRIPTION OF THE PREFERRED EMBODIMENTS

This invention include two distinct, separate features: one or more distributor rolls for uniform slurry entrance into the headbox, and the combination of an outer rectifier roll having a concentric similar inner roll, or an outer rectifier roll having other types of inner members, for defloccing the fibrous slurry in its travel to the discharge point of the headbox slice depositing the slurry onto the papermachine forming wire.

The distributor roll included herein comprises a rotating and/or oscillating round tube or shell, open headed and journaled for support and drive at each end, and having a multiplicity of perforations in the roll's shell of graduated diameters, the drilling pattern for such holes calulated to allow an equal liquid volume to exit each inch or other lineal unit along the roll, such exits extending from the roll's ends to its axial center (the roll's midpoint), said roll receiving the two continuous, opposing slurry flows of equal volume and pressure from a symmetrical dual-branched header (not shown), one branch to each roll end, connecting to an opening in bottom of each inlet box as shown in FIG. 4 of the drawings.

The second feature, termed a double rectifier roll defloccing "cluster," included herein, comprises an outer perforated master defloccing rectifier roll and an inner defloccing element consisting of a similar roll, splined or unsplined, or a series of spoked wheels with or without foils, located concentrically inside the master roll, both outer and inner components of such defloccing clusters rotating and/or oscillating. Approximately 180-degrees of the outer roll of said cluster is closely contained within bulges in the upper and lower front plates running transversely to the headbox and the forming wire, thus enabling the defloccing of the slurry in close proximity to the slice of the headbox serving a papermachine, such defloccing being significantly maximized, which is reflected in higher quality, more economically produced paper products. Of the 180-degrees of the master roll enclosed by the bulges in the front plates, a small portion is open symmetrically on the horizontal centerline of the headbox slice. FIG. 2 and other drawings show this cluster to slice relationship.

In the vertical twin wire embodiment of FIG. 3, this cluster is located entirely within the tapered slice.

I claim:

1. A headbox in a papermaking machine comprising: a pressure-tight chamber substantially long rectangular in cross-section and width, having front and back walls, end plates, top seal cover, floor-baseplate and a slice having a slice discharge opening, said chamber and said slice extending across the width of a forming wire of said paper-making machine; a double rectifier roll defloccing cluster and at least one distributor roll contained in said chamber, the height of said chamber being sufficient to totally submerge said rolls in a fibrous slurry; said double rectifier roll defloccing cluster comprising an outer perforated master defloccing roll and an inner defloccing element chosen from the group consisting of a roll or spoked wheel located concentrically inside said master defloccing roll; said slice having upper and lower front plates configured to form a semicircular outward bulge across each front plate directly adjacent to the slice discharge opening, said double rectifier roll defloccing cluster located such that said bulge encompasses approximately 180 degrees of said master defloccing roll and said master defloccing roll is located so as to maintain a microclearance between the inner surfaces of said bulge and said master defloccing roll to allow rotation and/or oscillation of the outer master defloccing roll and its inner defloccing element; said chamber having a rear stabilizing wall.

2. A headbox in a vertical twin-wire papermaking machine comprising: a chamber substantially long rectangular in cross section and width, having front and rear vertical side walls, end plates, top seal cover and a slice having a slice discharge opening, said chamber and said slice extending across the width of a forming wire of said papermaking machine; a double rectifier roll defloccing cluster and at least one distributor roll contained in said chamber, the height of said chamber being sufficient to totally submerge said rolls in a fibrous slurry; said double rectifier roll defloccing cluster comprising an outer perforated master defloccing rectifier roll and an inner defloccing element chosen from the group consisting of a roll or spoked wheel located concentrically inside said master defloccing roll; said slice comprising symmetrically tapered fixed walls converging to form a vertical spout, or funnel slice; said tapered walls contiguous with said front and rear side walls, each slice wall having a flexible knife-lip with pivoted linkage for varying the width and angle of the slice discharge opening, said double rectifier roll defloccing cluster located so as to project substantially totally into said tapered slice.

3. A headbox according to claim 1 or 2 wherein said at least one distributor roll comprises a perforated roll having a drilling pattern of holes of graduated diameters calculated to evenly discharge slurry into a slurry pond surrounding or below said at least one distributor roll; means by which said distributor roll is fed at each end by a uniform volume of slurry flowing axially through said roll and through said graduated perforations into the surrounding slurry pond.

4. A headbox according to claim 1 or 2 wherein said inner defloccing element comprises a spoked wheel with or without airfoil tips, said spokes with or without perforations, or a splined or unsplined wheel with or without perforations.

* * * * *